United States Patent [19]

Sassak

[11] Patent Number: 4,545,574

[45] Date of Patent: Oct. 8, 1985

[54] FLUID SUSPENDED PASSENGER CARRYING SPHERICAL BODY HAVING UNIVERSAL ATTITUDE CONTROL

[76] Inventor: John J. Sassak, 36855 Schoolcraft, Livonia, Mich. 48150

[21] Appl. No.: 508,078

[22] Filed: Jun. 27, 1983

Related U.S. Application Data

[63] Continuation-in-part of Ser. No. 431,847, Sep. 30, 1982, Pat. No. 4,487,410.

[51] Int. Cl.[4] ..... A63J 5/12; G09B 9/08

[52] U.S. Cl. ..... 272/6; 434/34; 434/55

[58] Field of Search ..... 434/55, 56, 57, 34, 434/258, 53, 54, 29, 30, 33, 35, 45, 46, 51, 59; 272/6, 7, 130, 109, 115, 16, 17, 18, 1 C, 1 R, 2, 24; 73/147, 861.75

[56] References Cited

U.S. PATENT DOCUMENTS

| | | | |
|---|---|---|---|
| 817,381 | 4/1906 | Matson | 272/6 |
| 2,229,201 | 1/1941 | Williford et al. | 272/6 |
| 2,304,341 | 12/1942 | Dennis | 272/41 |
| 2,344,454 | 3/1944 | Plotner | 434/55 |
| 2,799,460 | 7/1957 | Hastings | 73/147 X |
| 2,910,865 | 11/1959 | Opdyke | 73/147 |
| 3,135,057 | 6/1964 | Nelson et al. | 434/34 |
| 3,484,953 | 12/1969 | Norheim, Jr. | 272/2 UX |
| 4,272,093 | 6/1981 | Filice et al. | 104/68 X |

FOREIGN PATENT DOCUMENTS

| | | | |
|---|---|---|---|
| 412391 | 4/1925 | Fed. Rep. of Germany | 272/6 |
| 813722 | 3/1937 | France | 272/6 |
| 125564 | 4/1919 | United Kingdom | 73/147 |
| 2094162 | 9/1982 | United Kingdom | 272/2 |

*Primary Examiner*—Robert A. Hafer
*Assistant Examiner*—Arnold W. Kramer
*Attorney, Agent, or Firm*—Charles W. Chandler

[57] ABSTRACT

Amusement apparatus is disclosed comprising a spherical passenger-holding body, and a vertical tube having a diameter sufficient to receive the body in a vertical path of motion. A turbine for moving air through the tube is located at the upper end of the tube for raising the body from the lower inlet end toward the upper end of the tube. To change the attitude of the body in its raised position, two sets of controls are utilized which are both manipulated by the passenger. Louver members externally mounted permits revolution of the body about its vertical axis by reaction to the air. Two U-shaped members in perpendicular planes are rotatably mounted at their ends in the body. Each has a weight slidable along its member, with the weights pivotally joined to each other. The passenger loaded body is wheeled on a cart to a position below the tube, and on actuation of the air the body is suspended in the tube, and by simultaneous manipulation of the louver members and the position of the weights, the air suspended body can assume any universal attitude desired.

12 Claims, 5 Drawing Figures

FLUID SUSPENDED PASSENGER CARRYING SPHERICAL BODY HAVING UNIVERSAL ATTITUDE CONTROL

CROSS REFERENCE TO RELATED APPLICATION

This invention is a Continuation-In-Part of my copending application Ser. No. 431,847 filed Sept. 30, 1982, now U.S. Pat. No. 4,487,410, issued Dec. 11, 1984.

BACKGROUND OF THE INVENTION

This invention is related to apparatus for raising or lowering a passenger-holding body on a cushion of air, and more specifically to apparatus for raising a spherical body in a tube by reducing the air pressure above the body.

Motion and flight simulators usually comprise a hollow body or frame for receiving a passenger. In my aforementioned patent application, apparatus was disclosed for elevating a passenger in a spherical body to a selected height by pressurized air delivered beneath the body. The body was mounted in a semispherical base having an upright tube mounted above the base. The body was raised in the tube by a turbine located beneath the base.

SUMMARY OF THE INVENTION

The broad purpose of the present invention is to provide another means for raising a passenger-holding body in a vertical tube by mounting the turbine means at the upper end of the tube so that the body is raised by reducing the air pressure above the sphere so that it rises in the tube. When the body is in an elevated position, the passenger can revolve the sphere by displacing a weight to shift the body's center of gravity. The passenger can turn the body about its vertical axis by manipulating a louver mounted on the surface of the body.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
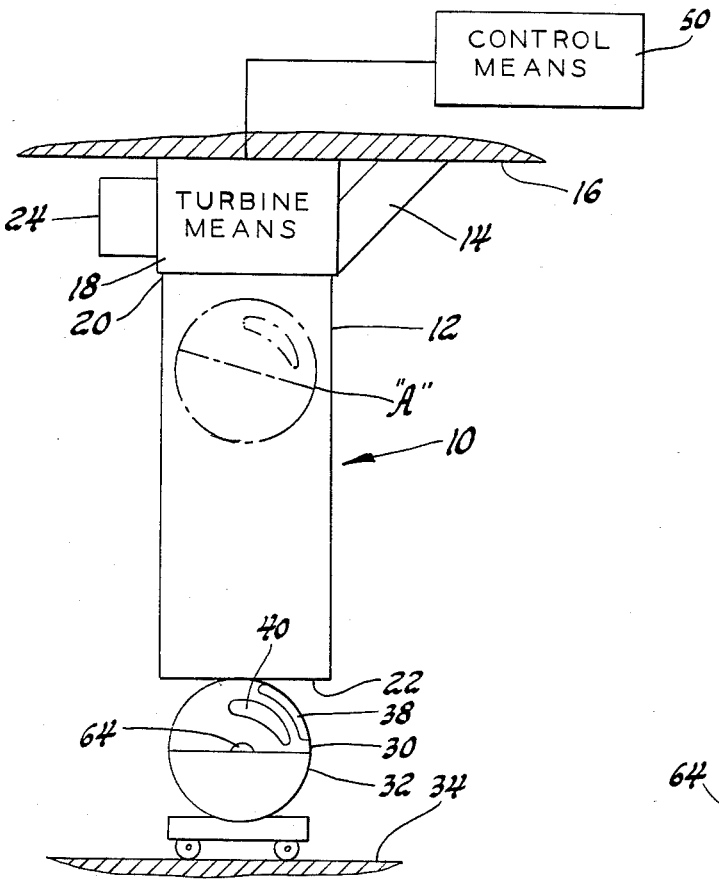
FIG. 1 is a view showing an amusement device illustrating the preferred embodiment of the invention.

Referring to the drawing, FIG. 1 illustrates a preferred amusement device 10 comprising a vertical cylindrical tube 12 connected by support means 14 to ceiling 16. Turbine means 18 are mounted between the tube's upper end 20 and ceiling 16. The turbine means are adapted to move air through lower inlet end 22 of the tube toward outlet 24.

Spherical body 30 is mounted on wheeled means 32 beneath the inlet end of the tube. Wheeled means 32 is mounted on floor 34 so that body 30 can be moved from a loading position in which passenger 36 is received into the body through an opening formed by sliding closure 38. The body has transparent window means 40 permitting the passenger to view objects outside of the body.

The diameter of the body is such that when the turbine is receiving air through the lower inlet end of the tube, the reduced pressure or vacuum acts above the body to raise it and the passenger several feet to any selected position such as at "A" illustrated in phantom in FIG. 1. The body is raised and lowered by external controls 50 which control the operation of the turbine means.

Figure 2:
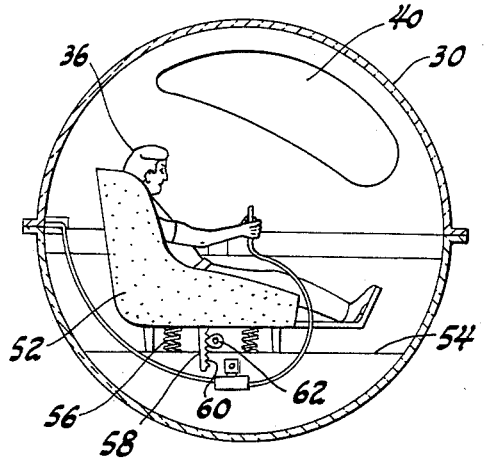
FIG. 2 is a fragmentary view illustrating the internal arrangement of the body.

Referring to FIG. 2, six-way chair 52 is mounted in body 30 on floor 54. Spring means 56 are mounted between the bottom of the chair and the floor. A rack 58 is carried by the chair and has a series of teeth 60 engagable with dog 62 in such a manner that when the passenger sits in the chair, the chair is lowered according to the passengers weight and then locked in position by the dog engaging the rack teeth. Thus the position of the chair accomodates the passenger's weight.

Figure 3:
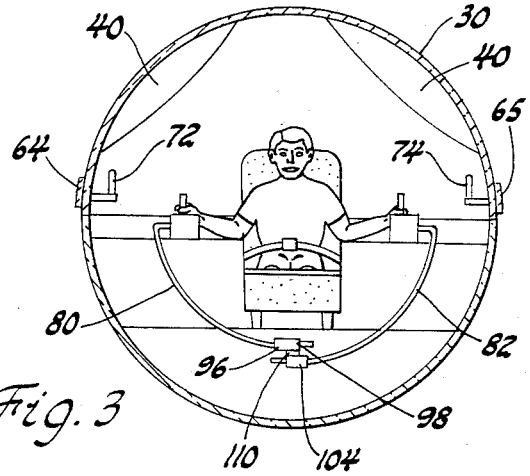
FIG. 3 is another internal view illustrating the controls.
Figure 5:
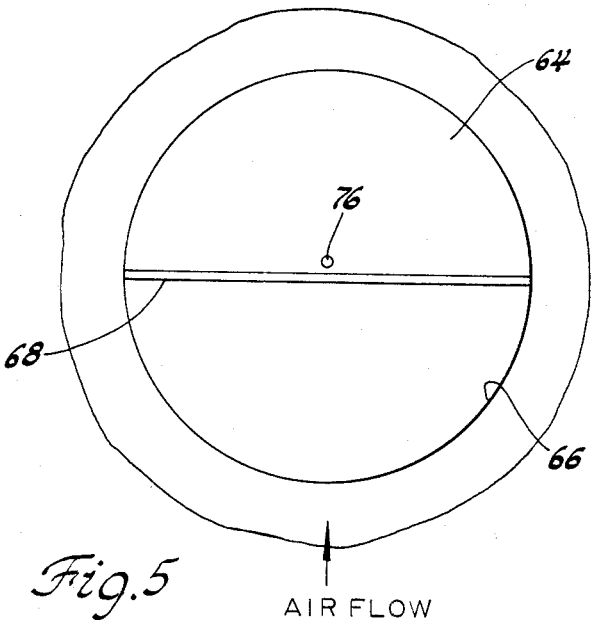
FIG. 5 is an enlarged view of one of the louvers.

To change the attitude of the body in its raised position, two sets of controls are provided. Referring to FIGS. 3 and 5, louver means 64 and 65 are mounted in slightly recessed areas 66 in the surface of the body. Several identical louver means are disposed around the periphery of the body and each includes a bottom linear surface 68 having a thickness sufficient to provide a barrier to air flow along the body surface.

Internally mounted handle 72 is connected to louver 64, and a second handle 74 is connected to louver 65. Each louver can be disposed in a generally horizontal position, illustrated in FIG. 5, in which the louver is in a neutral position. By slightly tilting louver 64 about pivot 76, the air moving upwardly and closely adjacent the body surface biases the body in the direction toward which the louver has been tilted. By reversing the louver tilt, the bias of the air is directed in the opposite direction. The result is that the body can be revolved about its vertical axis in a direction depending upon the tilt of the louvers.

Figure 4:
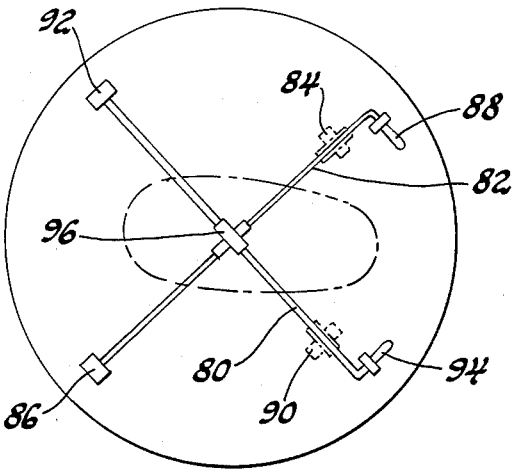
FIG. 4 is a plan view of the weight control section.

The second control system is a weight control means illustrated in FIGS. 2, 3, and 4, and comprises a pair of U-shaped rods 80 and 82 mounted within the body. Bearing means 92 support one end of rod 80, and bearing 90 supports its opposite end. The two bearings are on opposite sides of chair 52. Handle 94 provides means for the passenger to pivot the mid-section of the rod.

Similarly, bearing 86 supports one end of rod 82, and a second bearing 84 supports the opposite end of the rod. Handle 88 is connected to one end of rod 82 so that the user can pivot it about its mid-section.

The two rods are mounted so that a portion of the U-shaped section of each is always adjacent a portion of the U-shaped section of the other. Weight means 96 connect the two rods together at their closest position. The weight means include a hollow weight member 98 having internally mounted bearing means so that the weight member can be readily moved along rod 80. A second hollow weight 104, having internally mounted bearing means, rides along U-shaped rod 82. Weight members 98 and 104 are connected by swivel means 110 which permit the two weights to pivot with respect to one another.

The two U-shaped rods are illustrated in FIG. 4 with the weight means mounted beneath chair 52 in neutral position. The passenger can move handle 94 to raise rod 80 towards his front left, thereby moving both weight members 96 along rod 82 to his front left. The displacement of this weight causes the top of the spherical body to revolve downward toward his left front.

Similarly, by moving weight means 96 along rod 80 toward the passenger's right front, the shift in the center of gravity of the body and passenger will cause the top of the spherical body to revolve downwardly toward the passenger's right front. By appropriately moving both of the rods, the weight means can be moved in any selected horizontal direction so that the change in the center of gravity of the body can be precisely controlled, thereby controlling the direction that the spherical body revolves. The arrangement is such the body can be revolved to an inverted position as it is being raised through tube 12.

A series of simulated gages are disposed within the body to give a realistic appearance. The user can operate a video game, and in combination with the body motion simulate space travel. As an alternative, he can observe an externally mounted screen (not shown) through the transparent windows to experience simulated space travel.

Having described my invention I claim:

1. Apparatus comprising:

a base;

a spherical, passenger-holding body having closure means for receiving a passenger therein, the body being adapted to be mounted on the base in a lower position;

an upright tube having a lower opening and being mounted above the base for receiving the body as it is being raised from said lower position, to guide the body along a predetermined upward path of motion defined by the tube;

means for passing a fluid through the lower opening in the tube to raise the body above said lower position such that the body is supported solely by the fluid being received through the lower opening in the tube;

said fluid passing means being disposed above the lower opening of the tube and above the body at such times as the body is suspended in the tube;

external control means and internal control means, each having means adapted to be manipulated by the passenger to jointly control the universal attitude of the body when suspended in and by the fluid, the external control means biasing the body by reaction to the fluid and the internal control means biasing the body by imbalance.

2. Apparatus as defined in claim 1, in which the fluid moving means comprises a turbine means.

3. Apparatus as defined in claim 1, in which tube is mounted in an upright position.

4. Apparatus as defined in claim 1, including weight means mounted in the body, and means for moving the weight means with respect to the body such that the combined center of gravity of the body and a passenger therein is operative to revolve the body at such times as the body is supported solely by air pressure in the tube.

5. Apparatus as defined in claim 1, in which the external control means comprises at least one louver member mounted adjacent the exterior surface of the body so as to be movable in a plane parallel to the exterior surface of the body; and the means adapted for manipulation by the passenger being mounted in the body for moving the louver member to adjust the attitude of the body with respect to the tube.

6. Apparatus as defined in claim 5, in which the louver member is a planar member supported substantially parallel to the exterior surface of the body, and including means for moving the louver member along a path of motion parallel to the surface of the body so as to be disposed in the path of motion of fluid passing closely adjacent the exterior surface of the body.

7. Apparatus as defined in claim 5, including means supporting the louver member for motion between a first position and a second position, such that the air being passed from beneath the body along the surface thereof biases the body toward motion in a first direction when the louver is in said first position and in the opposite direction when the louver is in its second position.

8. Apparatus as defined in claim 5, wherein the means for manipulation by the passenger includes handle means mounted in the body for the passenger to move the louver to a selected position.

9. Apparatus as defined in claim 1, in which the internal control means includes a first elongated member mounted in the body, said first elongated member having a mid-section supported by a pair of ends;

means mounting the ends of the first elongated member such that the mid-section thereof is swingable about said ends;

a second elongated member mounted in the body, the second elongated member having a mid-section supported by a pair of ends;

means mounting the ends of the second elongated member in the body such that the mid-section is swingable about the ends thereof in a motion independent of the motion of the first elongated member; and a controlled member supported on both of said elongated members so as to be movable along both of said elongated members to a position in the body depending upon the position of the first elongated member with respect to the second elongated member whereby the body can be revolved by moving the controlled member to a position in which it is horizontally spaced from the center of gravity of the body and the passenger.

10. Apparatus as defined in claim 9 in which each of said elongated members has a "U" shaped mid-section.

11. Apparatus as defined in claim 1, said body having a transparent window so that the passenger can view objects outside of the body.

12. Apparatus as defined in claim 1, in which the fluid comprises air.

* * * * *